US010559400B2

(12) United States Patent
Chin

(10) Patent No.: US 10,559,400 B2
(45) Date of Patent: Feb. 11, 2020

(54) FLEX FLAT CABLE STRUCTURE AND FIXING STRUCTURE OF CABLE CONNECTOR AND FLEX FLAT CABLE

(71) Applicant: ENERGY FULL ELECTRONICS CO., LTD., New Taipei (TW)

(72) Inventor: Hsu-Shen Chin, New Taipei (TW)

(73) Assignee: ENERGY FULL ELECTRONICS CO., LTD., New Taipei (TW)

( * ) Notice: Subject to any disclaimer, the term of this patent is extended or adjusted under 35 U.S.C. 154(b) by 0 days.

(21) Appl. No.: 15/420,442

(22) Filed: Jan. 31, 2017

(65) Prior Publication Data

US 2018/0166814 A1 Jun. 14, 2018

(30) Foreign Application Priority Data

Dec. 12, 2016 (TW) ..... 105218919 U

(51) Int. Cl.

| | |
|---|---|
| ***H01B 7/08*** | (2006.01) |
| ***H01R 13/66*** | (2006.01) |
| *H01R 24/60* | (2011.01) |
| *H01R 9/03* | (2006.01) |
| *H01R 12/77* | (2011.01) |
| *H01R 12/62* | (2011.01) |

(52) U.S. Cl.

CPC ..... *H01B 7/0861* (2013.01); *H01B 7/0823* (2013.01); *H01R 9/034* (2013.01); *H01R 12/62* (2013.01); *H01R 12/77* (2013.01); *H01R 24/60* (2013.01)

(58) Field of Classification Search

CPC ..... H01B 7/08; H01R 13/665

USPC ..... 174/117 F, 36; 439/660

See application file for complete search history.

(56) References Cited

U.S. PATENT DOCUMENTS

| | | | | | |
|---|---|---|---|---|---|
| 4,340,771 | A * | 7/1982 | Watts | H01B 11/1016 | 174/106 D |
| 4,835,394 | A * | 5/1989 | Steele | H01B 7/0861 | 174/103 |
| 4,973,794 | A * | 11/1990 | Steele | H01B 7/0861 | 174/103 |
| 5,260,128 | A * | 11/1993 | Ishii | B32B 15/08 | 428/328 |
| 5,374,778 | A * | 12/1994 | Hashimoto | H01B 11/08 | 174/102 R |
| 6,696,647 | B2 * | 2/2004 | Ono | H01B 11/1808 | 174/102 R |
| 6,740,808 | B1 * | 5/2004 | Chang | H01B 7/0861 | 174/113 R |
| 6,744,051 | B2 * | 6/2004 | Maydanich | H01B 7/0861 | 174/36 |

(Continued)

*Primary Examiner* — Chau N Nguyen

(74) *Attorney, Agent, or Firm* — WPAT, PC

(57) ABSTRACT

A flex flat cable structure includes metallic transmission lines having a power line and signal lines, first insulating jackets, a second insulating jacket, a third insulating jacket, and a shield layer. Each of the first insulating jackets encloses one of the metallic transmission lines. The second insulating jacket surrounds the first insulating jackets. The third insulating jacket encloses the first insulating jackets, and the second insulating jacket encloses the third insulating jacket. The shield layer is used to isolate the second insulating jacket from the third insulating jacket. The shield layer includes an insulating film, a first block layer, and a second block layer.

1 Claim, 3 Drawing Sheets

(56) References Cited

U.S. PATENT DOCUMENTS

| | | | | |
|---|---|---|---|---|
| 6,781,061 | B2 * | 8/2004 | Tanaka | H01B 7/0861 174/117 F |
| 6,803,518 | B2 * | 10/2004 | Chang | H01B 11/002 174/113 R |
| 6,864,420 | B2 * | 3/2005 | Li | B23K 26/04 174/106 R |
| 7,514,632 | B2 * | 4/2009 | Lin | H01B 7/0823 174/117 F |
| 7,758,374 | B2 * | 7/2010 | Yu | H01R 4/027 439/493 |
| 7,956,290 | B2 * | 6/2011 | Wang | H01B 11/00 174/117 F |
| 8,404,976 | B2 * | 3/2013 | Telley | H01B 13/0023 174/115 |
| 8,440,911 | B2 * | 5/2013 | Takamatsu | H01B 7/0861 174/117 F |
| 9,053,836 | B2 * | 6/2015 | Yagi | H01B 7/0861 |
| 9,437,982 | B2 * | 9/2016 | Wu | H01R 43/20 |
| 2004/0055772 | A1 * | 3/2004 | Tsutsui | H01B 11/1016 174/36 |
| 2008/0041610 | A1 * | 2/2008 | Cheng | H01B 7/0861 174/117 F |
| 2013/0105194 | A1 * | 5/2013 | Yagi | H01B 7/0861 174/103 |
| 2016/0360654 | A1 * | 12/2016 | Nakatani | H01B 11/1025 |

* cited by examiner

FLEX FLAT CABLE STRUCTURE AND FIXING STRUCTURE OF CABLE CONNECTOR AND FLEX FLAT CABLE

BACKGROUND

1. Field of the Disclosure

The present disclosure relates to a flex flat cable structure, and more particularly, to a flex flat cable structure for reducing electromagnetic interference (EMI).

2. Description of the Related Art

A flex flat cable (FFC) is a new type data line cable. The FFC is fabricated by an insulating material and a highly thin, flat tinned copper wire after the insulating material and the flat tinned copper wire are compressed in an automation device. A core is neatly arranged in the FFC, largely transmitted, structurally flat, compact in size, dismantled easily, and flexible so the FFC can be applied to all kinds of electronic products easily and flexibly. So the FFC as a data transmission cable is especially suitable for different high frequency bending conditions such as the connection of mobile components. The FFC can be plugged onto with a connector or directly welded on a printed circuit board (PCB).

In general, the trend toward designing electronic products is compactness so the downsizing of cable used in the electronic products in on trend. Also, the electronic products are equipped with transmission lines with a high transmission quality of signals since a high-speed data transmission speed is required to fit the market need. Problems that the interference among signal lines and that electromagnetic interference (EMI) produced while signals are transmitted need to be solved so as to improve the quality of the transmission lines. Conventionally, signal lines of a flex flat cable are enclosed with metallic film or are weaved to be a metallic grid so that the interference among neighboring signal lines during the high-speed transmission of signals can be lessened to a certain degree. However, all of the signal lines in the conventional flex flat cable are enclosed by only one layer of metallic film so the effect of anti-EMI is not poorer. Another drawback is that, a metallic grid which is weaved in the manufacturing process is vulnerable to loosening if being peeled off.

Therefore, it is necessary to propose a flex flat cable for improving EMI with a realizable and simple structure.

SUMMARY

In light of this, the present disclosure proposes a flex flat cable structure and a fixing structure of cable connector and the flex flat cable to solve the technical problem that a metallic grid weaved by a signal line formed by flat cable tends to get loose in the related art.

According to the present disclosure, a flex flat cable structure comprises: a plurality of metallic transmission lines, being arranged parallel, and comprising one or more power line and a plurality of signal lines; the power line being configured to transmit power; the plurality of signal lines being configured to transmit a data signal; a plurality of first insulating jackets, each of the plurality of first insulating jackets enclosing one of the plurality of metallic transmission lines; a second insulating jacket, surrounding the plurality of first insulating jackets; a third insulating jacket, enclosing the plurality of first insulating jackets, and the second insulating jacket enclosing the third insulating jacket; and a shield layer, configured to isolate the second insulating jacket from the third insulating jacket. The shield layer comprises: an insulating film, comprising a first side and a second side, and the first side and the second side being on opposite sides of the insulating film; a first block layer, adhering to the first side of the insulating film; and a second block layer.

In one aspect of the present disclosure, the flex flat cable structure further comprises a grounding line, being parallel to the plurality of metallic transmission lines, and being arranged on one side of the third insulating jacket. The grounding line is enclosed by the second insulating jacket.

In another aspect of the present disclosure, the second block layer adheres to the second side of the insulating film.

In still another aspect of the present disclosure, the first block layer is a layer of metallic film, and the second block layer is a layer of metallic film, a layer of conductive textile, or a layer of magnetic material.

In yet another aspect of the present disclosure, the second block layer adheres to the first block layer.

According to the present disclosure, a flex flat cable structure comprises: a plurality of metallic transmission lines, being arranged parallel, and comprising one or more power line and a plurality of signal lines; the power line being configured to transmit power; the plurality of signal lines being configured to transmit a data signal; the plurality of metallic transmission lines being divided into a plurality of transmission line sets; each of the plurality of transmission line sets comprising two or more metallic transmission lines; a plurality of first insulating jackets, two or more metallic transmission lines of each of the plurality of transmission line sets being enclosed by the plurality of first insulating jackets; the other metallic transmission lines of each of the plurality of transmission line sets being arranged at one side of the first insulating jacket; a second insulating jacket, enclosing the plurality of transmission line sets; and a plurality of shield layers, configured to isolate the first insulating jacket from the second insulating jacket. Each shield layer comprises: an insulating film, comprising a first side and a second side, and the first side and the second side being on opposite sides of the insulating film; a first block layer, adhering to the first side of the insulating film; and a second block layer.

In one aspect of the present disclosure, the two of the plurality of first insulating jackets enclosing the two or more metallic transmission lines are connected in each of the plurality of transmission line sets.

In another aspect of the present disclosure, the second block layer adheres to the second side of the insulating film.

In still another aspect of the present disclosure, the first block layer is a layer of metallic film, and the second block layer is a layer of metallic film, a layer of conductive textile, or a layer of magnetic material.

In yet another aspect of the present disclosure, the second block layer adheres to the first block layer.

According to the present disclosure, a flex flat cable structure comprises: a plurality of metallic transmission lines, being arranged parallel, and comprising one or more power line and a plurality of signal lines; the power line being configured to transmit power; the plurality of signal lines being configured to transmit a data signal; a first insulating jacket, enclosing the plurality of metallic transmission lines; a second insulating jacket, enclosing the first insulating jacket; a shield layer, configured to isolate the first insulating jacket from the second insulating jacket. The shield layer comprises: an insulating film, comprising a first side and a second side, and the first side and the second side being on opposite sides of the insulating film; a first block layer, adhering to the first side of the insulating film; and a second block layer.

In one aspect of the present disclosure, the flex flat cable structure further comprises a grounding line, being parallel to the plurality of metallic transmission lines, and being arranged on one side of the first insulating jacket. The grounding line is enclosed by the second insulating jacket.

In another aspect of the present disclosure, the second block layer adheres to the second side of the insulating film.

In still another aspect of the present disclosure, the first block layer is a layer of metallic film, and the second block layer is a layer of metallic film, a layer of conductive textile, or a layer of magnetic material.

In yet another aspect of the present disclosure, the second block layer adheres to the first block layer.

According to the present disclosure, a flex flat cable (FFC) electrical connector fix structure comprises an electrical connector and an FFC structure. The electrical connector, comprises: a housing; a spacer, assembled onto the housing, and comprising a plurality of containing recesses; a printed circuit board (PCB), comprising a plurality of conductive portions and a plurality of connecting portions, and the plurality of conductive portions being electrically connected to the plurality of corresponding connecting portions respectively; a plurality of terminals, one end of the plurality of terminals passing through the containing recess and being connected to the plurality of connecting portions; and a shell, assembled onto the housing. The FFC structure comprises: a plurality of metallic transmission lines, being arranged parallel, and comprising one or more power line and a plurality of signal lines; the power line being configured to transmit power; the plurality of signal lines being configured to transmit a data signal; a plurality of first insulating jackets, each of the plurality of first insulating jackets enclosing one of the plurality of metallic transmission lines; a second insulating jacket, surrounding the plurality of first insulating jackets; a third insulating jacket, enclosing the plurality of first insulating jackets, and the second insulating jacket enclosing the third insulating jacket; and a shield layer, configured to isolate the second insulating jacket from the third insulating jacket. The shield layer comprises: an insulating film, comprising a first side and a second side, and the first side and the second side being on opposite sides of the insulating film; a first block layer, adhering to the first side of the insulating film; and a second block layer.

Compared with the related art, all signal lines in the flex flat cable structure and the fixing structure of cable connector and the flex flat cable proposed by the embodiments of the present disclosure are enclosed by one or more shield layers. The shield layer includes an insulating film, a first block layer, and a second block layer. The shield layer includes two block layers so a better effect of metallic block is obtained. In addition, a matrix for the shield layer is an insulating film. Different kinds of materials are attached with adhesive to form a polymeric composite film. Therefore, the shield layer proposed by the present disclosure is enclosed by a film to decrease EMI for the cable, to simplify the structure of the product, and to reduce the manufacturing process of the cable.

These and other objectives of the claimed invention will no doubt become obvious to those of ordinary skill in the art after reading the following detailed description of the embodiment that is illustrated in the various figures and drawings.

DETAILED DESCRIPTION OF THE EMBODIMENTS

For better understanding embodiments of the present disclosure, the following detailed description taken in conjunction with the accompanying drawings is provided. Apparently, the accompanying drawings are merely for some of the embodiments of the present disclosure. Any ordinarily skilled person in the technical field of the present disclosure could still obtain other accompanying drawings without use laborious invention based on the present accompanying drawings.

The following descriptions of all embodiments, with reference to the accompanying drawings, are used to exemplify the present disclosure. Directional terms mentioned in the present disclosure, such as "top", "bottom", "front", "back", "left", "right", "inside", "outside", "side", etc., are only used with reference to the orientation of the accompanying drawings. Therefore, the used directional terms are intended to illustrate, but not to limit, the present disclosure.

Figure 1:
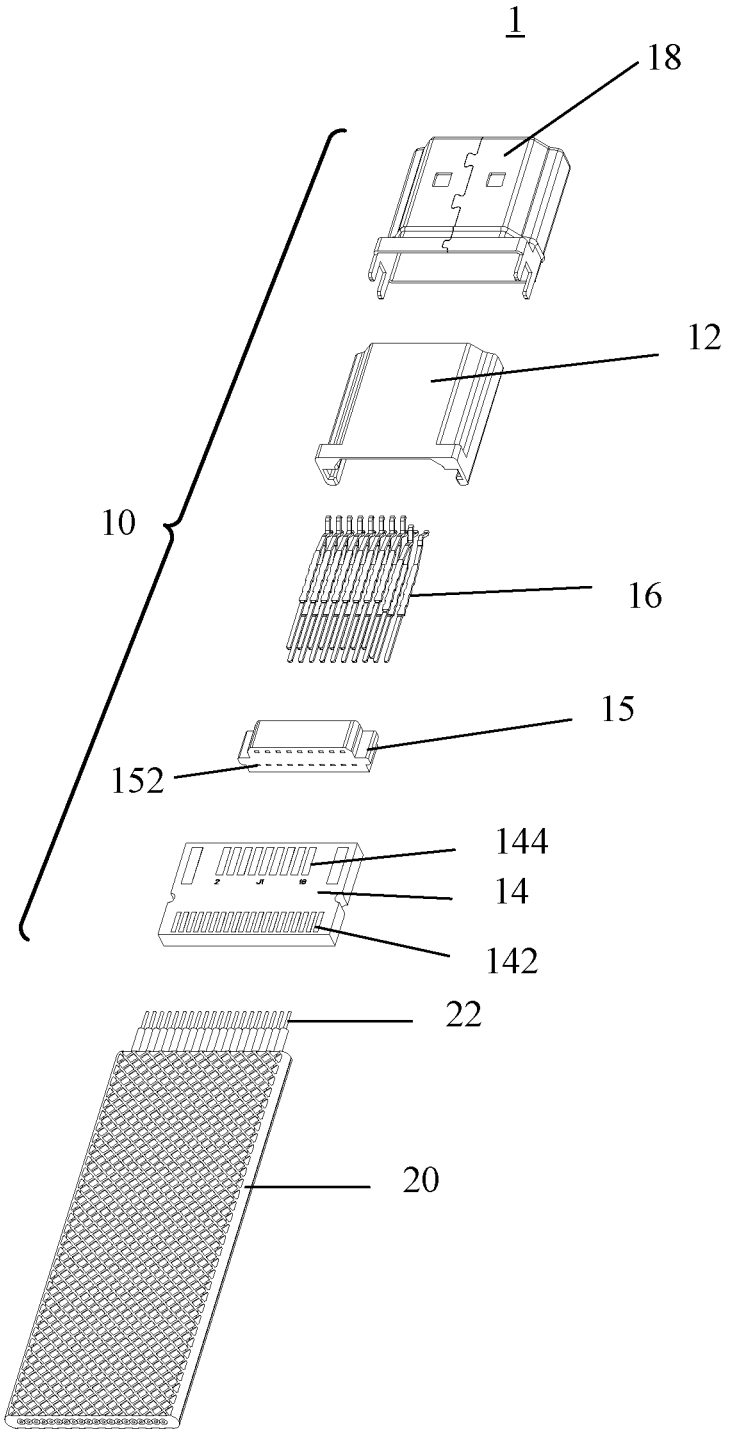
FIG. 1 shows an exploded view of a fixing structure of a cable connector and flex flat cable according to one embodiment of the present disclosure.

Please refer to FIG. 1 showing an exploded view of a fixing structure of a cable connector and flex flat cable 1 according to one embodiment of the present disclosure. The fixing structure of the cable connector and flex flat cable 1 includes a cable connector 10 and a flex flat cable structure 20. The FFC structure 20 is plugged onto the electrical connector 10. The electrical connector 10 may be a connector complying with the specifications such as HDMI/USB3.0/USB3.1/Display Port/SATA with a data rate larger than one Gb/s.

The cable connector 10 includes a substrate 12, a printed circuit board (PCB) 14, a spacer 15, a plurality of terminals 16, and a shell 18. The spacer 15 is assembled to the substrate 12. The spacer 15 includes a plurality of containers 152. The PCB 14 includes a plurality of conductive portions 142 which are on one surface of the PCB and a plurality of connecting portions 144. The plurality of conductive portions 142 are electrically connected to the plurality of conductive portions 142 correspondingly. One end of each of the plurality of terminals 16 passes through each of the plurality of containers 152 respectively and connected to the plurality of connecting portions 144. The shell 18 is assembled to the substrate 12.

Figure 2:
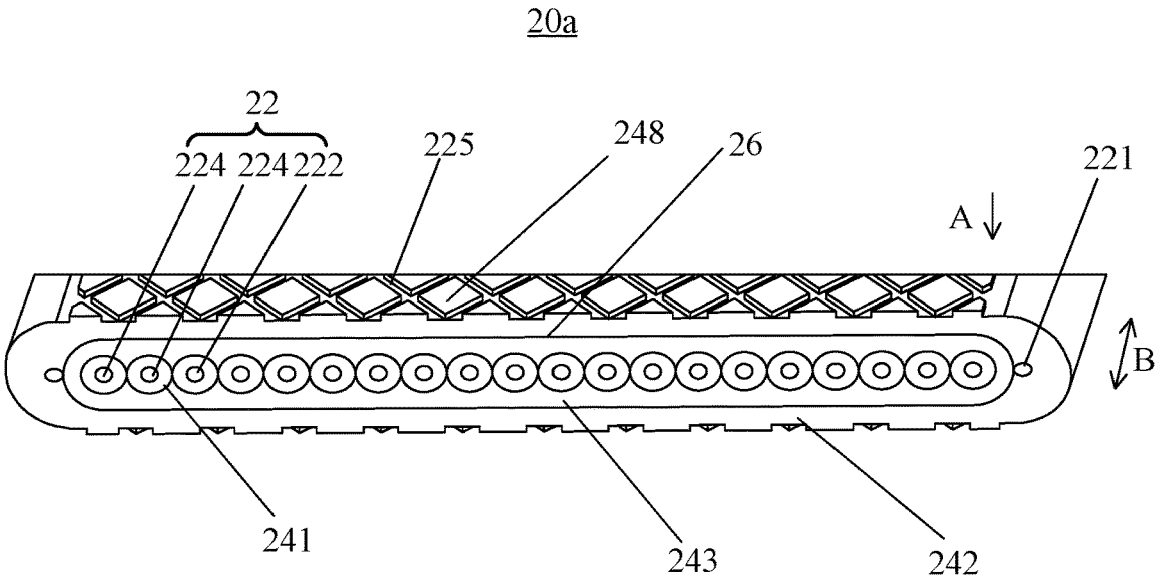
FIG. 2 shows a cross-sectional view of a flex flat cable structure according to a first embodiment of the present disclosure.

Please refer to FIG. 2 showing a cross-sectional view of a flex flat cable structure 20*a* according to a first embodiment of the present disclosure. The flex flat cable structure 20*a* includes a plurality of metallic transmission lines 22, a plurality of first insulating jackets 241, a second insulating jacket 242, a third insulating jacket 243, and a shield layer 26. The plurality of metallic transmission lines 22 are arranged parallel. Each of the plurality of metallic transmission lines 22 includes one or more power lines 222 and a plurality of signal lines 224. The more power line 222 is used to transmit power. Each of the plurality of signal lines 224 is used to transmit a data signal. The profile of the metallic transmission line 22 looks round. Each of the plurality of first insulating jackets 241 encloses one of the plurality of metallic transmission lines 22. The third insulating jacket 243 encloses the plurality of first insulating jackets 241, and the second insulating jacket 242 encloses the third insulating jacket 243. The second insulating jacket 242 surrounds the plurality of first insulating jackets 241. A coining pattern 248 is arranged on the external surface of both sides of the second insulating jacket 242. In this embodiment, a grounding line 221 for grounding and the plurality of metallic transmission lines 22 are in parallel, and the grounding line 221 is arranged on one side of the third insulating jacket 243 in this embodiment. The grounding line 221 is enclosed by the second insulating jacket 242. The shield layer 26 is used to isolate the second insulating jacket 242 from the third insulating jacket 243. Also, the shield layer 26 forms a metallic block for the plurality of metallic transmission lines 22. The grounding line 221 is electrically to the shield layer 26. The plurality of metallic transmission lines 22 of the flex flat cable structure 20*a* protrude from the second insulating jacket 242 and the first insulating jackets 241. When the flex flat cable structure 20*a* is inserted in the cable connector 10, the protruded metallic transmission line 22 may be electrically connected to the conductive portion 142 of the PCB 14. The embossment pattern 248 may be a pattern of a plurality of parallel lines or a plurality of curves or a pattern having cells, each cell shaped as a round, an oval, a triangle, a square, a diamond, a hexagon, etc. The embossment pattern 248 may also be an irregularly arranged pattern or a plurality of consecutive bumps. Preferably, the embossment pattern 248 is arranged on the external surface of the second insulating jacket 242; the embossment pattern 248 comprises a plurality of meander lines 225 in a top-view direction A and in an extending direction B for the plurality of metallic transmission wires 22. The plurality of meander lines 225 are not arranged parallel and formed on recesses or protrusions arranged on the external surface of the second insulating jacket 242. The embossment pattern 248 is formed on the external surface of the second insulating jacket 242 after being compressed in an automation compression device directly.

Figure 3:
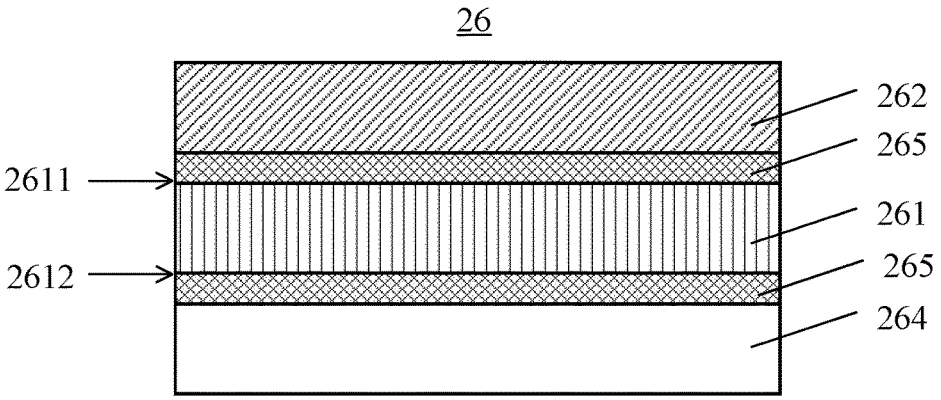
FIG. 3 shows a partially enlarged drawing of the shield layer according to the first embodiment of the present disclosure.

Please refer to FIG. 3 showing a partially enlarged drawing of the shield layer 26 according to the first embodiment of the present disclosure. The shield layer 26 includes an insulating film 261, a first block layer 262, and a second block layer 264. The insulating film 261 may be made from polyimide (PI), polyethylene terephthalate (PET), and the like. The insulating film 261 includes a first side 2611 and a second side 2612. The first side 2611 and the second side 2612 are on opposite sides of the insulating film 261. The first block layer 262 adheres to the first side 2611 of the insulating film 261 with an adhesive 265. The second block layer 264 adheres to the second side 2612 of the insulating film 261 with the adhesive 265. The first block layer 262 is a layer of metallic film such as aluminum film. The second block layer 264 is a layer of metallic film such as copper film, conductive textile, or magnetic material.

Figure 4:
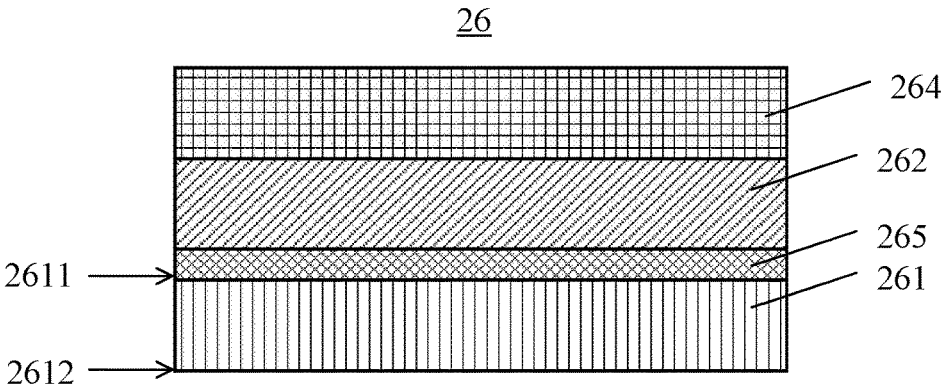
FIG. 4 shows a partially enlarged drawing of a shield layer according to a second embodiment of the present disclosure.

Please refer to FIG. 4 showing a partially enlarged drawing of a shield layer 26 according to a second embodiment of the present disclosure. The shield layer 26 includes an insulating film 261, a first block layer 262, and a second block layer 264. The insulating film 261 may be made from polyimide (PI), polyethylene terephthalate (PET), and the like. The insulating film 261 includes a first side 2611 and a second side 2612. The first side 2611 and the second side 2612 are on opposite sides of the insulating film 261. The first block layer 262 adheres to the first side 2611 of the insulating film 261 with a adhesive 265. The first block layer 262 is a layer of metallic film such as aluminum film. The second block layer 264 adheres to the first block layer 262. Preferably, the second block layer 264 is a metallic thin film coated on the first block layer 262, and the second block layer 264 may be a copper-coated layer or a layer coated with other sorts of metals.

Preferably, the first insulating jacket 241, the second insulating jacket 242 and the third insulating jacket 243 may be insulating materials with highly thermal resistance such as polyethylene (PE), polyvinyl chloride (PVC), Thermoplastic Elastomer (TPE), Thermoplastic Polyurethane (TPU), thermoplastic rubber (TPR), Thermoplastic Polyolefin (TPO), Polyurethane (PUR), Polypropylene (PP), Polyolefins (PO), PolyVinyliDene Fluoride (PVDF), Ethylene-chlorotrifluoroethylene copolymer (ECTFE), ethylene-tetra-fluoro-ethylene (ETFE), Teflon Fluorinated ethylene propylene (Teflon FEP), Polytetrafluoroethene (PTFE), Teflon, and nylon. The metallic transmission wire 22 may be a highly thin, flat tinned copper wire.

Figure 5:
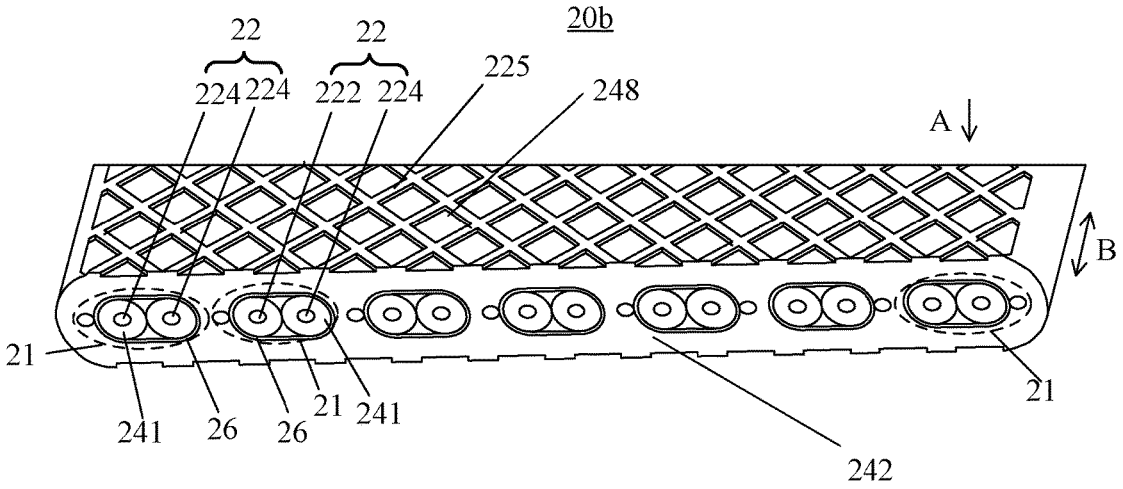
FIG. 5 shows a cross-sectional view of a flex flat cable structure according to the second embodiment of the present disclosure.

Please refer to FIG. 5 showing a cross-sectional view of a flex flat cable structure 20*b* according to the second embodiment of the present disclosure. The flex flat cable structure 20*b* includes a plurality of transmission line sets 21, a shield layer 26, a plurality of first insulating jackets 241, and a plurality of second insulating jackets 242. Each transmission line set 21 includes a plurality of metallic transmission wires 22 arranged in parallel. The metallic transmission wire 22 comprises one or more power wires 222 and a plurality of signal wires 224. The power wire 222 is used to transmit power, and the signal wire 224 is used to transmit a data signal. The profile of the metallic transmission wire 22 looks like a round. The two or more metallic transmission wires 22 in each of the plurality of the transmission line sets 21 are enclosed by the plurality of first insulating jackets 241. The other metallic transmission wires 22 in each of the plurality of the transmission line sets 21 are arranged at one side of the first insulating jacket 241. The plurality of the transmission line sets 21 are enclosed by the second insulating jacket 242. An embossment pattern 248 is arranged on the external surface of the second insulating jacket 242. The plurality of first insulating jackets 241 are enclosed by the second insulating jacket 242. The other metallic transmission wires 22 in each of the plurality of the transmission line sets 21, which are not enclosed by the first insulating jacket 241, are enclosed by the second insulating jacket 242. The two first insulating jackets 241 in the two or more metallic transmission wires 22 in each of the plurality of the transmission line sets 21 contact with each other.

In this embodiment, grounding lines 221 parallel with the metallic transmission wires 22 and at one side of the first insulating jacket 241 are connected to ground. Each transmission line set 21 includes two metallic transmission wires 22 and one grounding line 221. The grounding line 221 of the transmission line set 21 is enclosed by the second insulting jacket 242. The shield layer 26 is used to isolate the first insulating jacket 241 from the second insulating jacket 242. Also, the shield layer 26 forms a metallic block for a plurality of metallic transmission lines 22. The structure of the shield layer 26 is the same as the structure shown in FIG. 3 and in FIG. 4 so the structure of the shield layer 26 will not be further detailed. In another embodiment, each transmission line set 21 includes three or more metallic transmission wires 22 and one grounding line 221. All of the metallic transmission wires 22 of the each transmission line set 21 are enclosed by the first insulating jacket 241. The shield layer 26 surrounds the first insulating jacket 241 and electrically connects to the grounding line 221.

The plurality of metallic transmission lines 22 of the flex flat cable structure 20*b* protrude from the second insulating jacket 242 and the first insulating jackets 241. When the flex flat cable structure 20*b* is inserted in the cable connector 10, the protruded metallic transmission line 22 may be electrically connected to the conductive portion 142 of the PCB 14. The embossment pattern 248 may be a pattern of a plurality of parallel lines or a plurality of curves or a pattern having cells, each cell shaped as a round, an oval, a triangle, a square, a diamond, a hexagon, etc. The embossment pattern 248 may also be an irregularly arranged pattern or a plurality of consecutive bumps. Preferably, the embossment pattern 248 is arranged on the external surface of the second insulating jacket 242; the embossment pattern 248 comprises a plurality of meander lines 225 in a top-view direction A and in an extending direction B for the plurality of metallic transmission wires 22. The plurality of meander lines 225 are not arranged parallel and formed on recesses or protrusions arranged on the external surface of the second insulating jacket 242. The embossment pattern 248 is formed on the external surface of the second insulating jacket 242 after being compressed in an automation compression device directly.

Preferably, the first insulating jacket 241 and the second insulating jacket 242 may be insulating materials with highly thermal resistance such as polyethylene (PE), polyvinyl chloride (PVC), Thermoplastic Elastomer (TPE), Thermoplastic Polyurethane (TPU), thermoplastic rubber (TPR), Thermoplastic Polyolefin (TPO), Polyurethane (PUR), Polypropylene (PP), Polyolefins (PO), PolyVinyliDene Fluoride (PVDF), Ethylene-chlorotrifluororthylene copolymer (ECTFE), ethylene-tetra-fluoro-ethylene (ETFE), Teflon Fluorinated ethylene propylene (Teflon FEP), Polytetrafluoroethene (PTFE), Teflon, and nylon. The metallic transmission wire 22 may be a highly thin, flat tinned copper wire.

Figure 6:
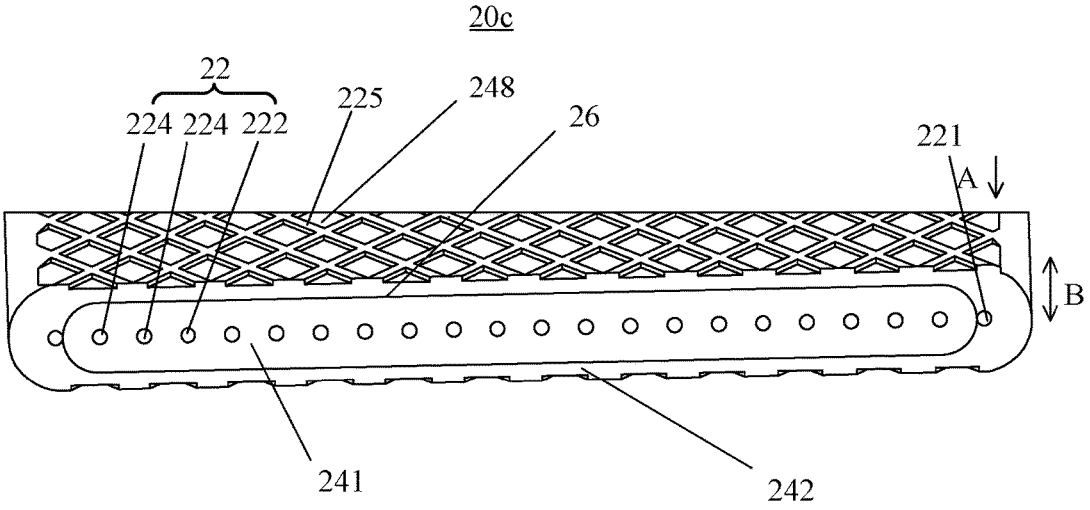
FIG. 6 shows a cross-sectional view of a flex flat cable structure according to a third embodiment of the present disclosure.

Please refer to FIG. 6 showing a cross-sectional view of a flex flat cable structure 20*c* according to a third embodiment of the present disclosure. The flex flat cable structure 20*c* includes a plurality of metallic transmission lines 22, a shield layer 26, a first insulating jacket 241, and a second insulating jacket 242. The metallic transmission wire 22 comprises one or more power wires 222 and a plurality of signal wires 224 arranged in parallel. The power wire 222 is used to transmit power, and the signal wire 224 is used to transmit a data signal. The profile of the metallic transmission wire 22 looks like a round. The plurality of metallic transmission lines 22 are enclosed by the first insulating jacket 241. The first insulating jackets 241 are enclosed by the second insulating jacket 242. An embossment pattern 248 is arranged on the external surface of the second insulating jacket 242. A grounding line 221 parallel with the metallic transmission wires 22 and at one side of the first insulating jacket 241 is connected to ground. The grounding line 221 is enclosed by the second insulting jacket 242. The shield layer 26 is used to isolate the first insulating jacket 241 from the second insulating jacket 242. Also, the shield layer 26 forms a metallic block for the plurality of metallic transmission lines 22. A grounding line 221 is electrically to the shield layer 26. The structure of the shield layer 26 is the same as the structure shown in FIG. 3 and in FIG. 4 so the structure of the shield layer 26 will not be further detailed. The plurality of metallic transmission lines 22 of the flex flat cable structure 20*c* protrude from the second insulating jacket 242 and the first insulating jacket 241. When the flex flat cable structure 20*c* is inserted in the cable connector 10, the protruded metallic transmission line 22 may be electrically connected to the conductive portion 142 of the PCB 14. The embossment pattern 248 may be a pattern of a plurality of parallel lines or a plurality of curves or a pattern having cells, each cell shaped as a round, an oval, a triangle, a square, a diamond, a hexagon, etc. The embossment pattern 248 may also be an irregularly arranged pattern or a plurality of consecutive bumps. Preferably, the embossment pattern 248 is arranged on the external surface of the second insulating jacket 242; the embossment pattern 248 comprises a plurality of meander lines 225 in a top-view direction A and in an extending direction B for the plurality of metallic transmission wires 22. The plurality of meander lines 225 are not arranged parallel and formed on recesses or protrusions arranged on the external surface of the second insulating jacket 242. The embossment pattern 248 is formed on the external surface of the second insulating jacket 242 after being compressed in an automation compression device directly.

Preferably, the first insulating jacket 241 and the second insulating jacket 242 may be insulating materials with highly thermal resistance such as polyethylene (PE), polyvinyl chloride (PVC), Thermoplastic Elastomer (TPE), Thermoplastic Polyurethane (TPU), thermoplastic rubber (TPR), Thermoplastic Polyolefin (TPO), Polyurethane (PUR), Polypropylene (PP), Polyolefins (PO), PolyVinyliDene Fluoride (PVDF), Ethylene-chlorotrifluororthylene copolymer (ECTFE), ethylene-tetra-fluoro-ethylene (ETFE), Teflon Fluorinated ethylene propylene (Teflon FEP), Polytetrafluoroethene (PTFE), Teflon, and nylon. The metallic transmission wire 22 may be a highly thin, flat tinned copper wire.

According to the present disclosure, all signal lines in the flex flat cable structure are enclosed by one or more shield layers. The shield layer includes an insulating film, a first block layer, and a second block layer. The shield layer includes two block layers so a better effect of metallic block is obtained. In addition, a matrix for the shield layer is an insulating film. Different kinds of materials are attached with adhesive to form a polymeric composite film. Therefore, the shield layer proposed by the present disclosure is enclosed by a film to decrease EMI for the cable, to simplify the structure of the product, and to reduce the manufacturing process of the cable.

Although the present disclosure has been disclosed as preferred embodiments, the foregoing preferred embodiments are not intended to limit the present disclosure. Those of ordinary skill in the art, without departing from the spirit and scope of the present disclosure, can make various kinds of modifications and variations to the present disclosure. Therefore, the scope of the claims of the present disclosure must be defined.

What is claimed is:

1. A flex flat cable (FFC) electrical connector fix structure, comprising:

an electrical connector, comprising:

a housing;

a spacer, assembled onto the housing, and comprising a plurality of containing recesses;

a printed circuit board (PCB), comprising a plurality of conductive portions and a plurality of connecting portions, and the plurality of conductive portions being electrically connected to the plurality of corresponding connecting portions respectively;

a plurality of terminals, one end of the plurality of terminals passing through the containing recess and being connected to the plurality of connecting portions; and a shell, assembled onto the housing; and an FFC structure, comprising:

a plurality of metallic transmission lines, being arranged parallel, and comprising one or more power line and a plurality of signal lines; the power line being configured to transmit power; the plurality of signal lines being configured to transmit a data signal;

a plurality of first insulating jackets, each of the plurality of first insulating jackets enclosing one of the plurality of metallic transmission lines;

a second insulating jacket, surrounding the plurality of first insulating jackets;

a third insulating jacket, enclosing the plurality of first insulating jackets without any gap, and the second insulating jacket enclosing the third insulating jacket; and a shield layer, configured to isolate the second insulating jacket from the third insulating jacket, comprising:

an insulating film, comprising a first side and a second side, and the first side and the second side being on opposite sides of the insulating film;

a first block layer, adhering to the first side of the insulating film; and a second block layer, adhering to and contacting the first block layer, wherein the first block layer and the second block layer are made of different materials, wherein all of the plurality of metallic transmission wires are respectively connected to all of the plurality of conductive portions on one surface of the PCB, wherein the printed circuit board is between the FFC structure and the spacer.

* * * * *